United States Patent [19]

Garcia Ramos

[11] Patent Number: 4,911,650

[45] Date of Patent: Mar. 27, 1990

[54] COMPUTER CONNECTOR WITH AN AUTOMATIC LOOP

[76] Inventor: Evaristo Garcia Ramos, General Yague, 15-2°B, 28020 Madrid, Spain

[21] Appl. No.: 232,926

[22] Filed: Aug. 16, 1988

[30] Foreign Application Priority Data

Dec. 3, 1987 [ES] Spain ..... 8703471

[51] Int. Cl.[4] ..... H01R 33/96

[52] U.S. Cl. ..... 439/188; 200/51.1

[58] Field of Search ..... 439/188; 200/51.1, 51.09, 200/292

[56] References Cited

U.S. PATENT DOCUMENTS 2,197,426 4/1940 Del Camp ..... 200/51.1

2,308,911 1/1943 Campodonico ..... 200/51.1

*Primary Examiner*—Neil Abrams

*Attorney, Agent, or Firm*—Darby & Darby

[57] ABSTRACT

A computer connector with an automatic loop closure device, said device comprising two flexible metal sheets fixed by one of their ends to the printed circuit plate, so that they are operated by the opposed end by means of pins, which, adequately mounted on the support block, are displaced and press the free ends of the sheets as the cable end connector is coupled to the fixed connector, the device being opened in this case, while, when taking out the cable end connector, the sheets, due to their elasticity, recover their initial position, thereby producing the closure of the device which gives the loop continuity.

1 Claim, 2 Drawing Sheets

COMPUTER CONNECTOR WITH AN AUTOMATIC LOOP

The present invention refers to a connector.

Computer science has developed for the last few years from closed systems, handled by specialists who acted as mediators before users, to open systems with stations scattered about all those points where information can be generated, processed or used by people who are not professionals in computer science.

It is generally admitted that in most undertakings more than one half of the information is exchanged within themselves, between the corresponding working stations. There arise then the need to link to each other these stations by means of a cable network within the local areal of the undertaking.

These networks may adopt different patterns, one of the most use among them being the so-called looped network, which usually consists of a pair of electric wires, insulated from each other, and of a wire mesh that wraps them and behaves as a protection screen against electromagnetic disturbances of the environment. This pair covers, going in and out, every station, linking them to each other like a loop, with no beginning and no end, although one of them often takes over certain control functions and the loop is then considered to begin and finish into it.

The information received in a station moves along the loop in only one direction and is intercepted by the station to which it is directed or which needs it.

it is obvious that, so that the system works, the loop can not be interrupted.

During the system operation, it might happen that it was necessary to substitute or delete one station. As machines are connected to the loop by connectors, it would enough to disconnect them and make the substitution; but, the loop would be interrupted during the time this operation took to be carried out, which is not desirable, since, if a station is deleted, the loop would permanently be opened and the system could not work.

A simple way to minimize, although not solving, these disadvantages, is to link in between the loop inlet and outlet connectors to the station by a cable having the adequate connectors at its ends, the loop continuity being thus recovered.

With this solution, the interruption time is short, but it exists.

The appropriate way to solve this problem is to link in between, by some device, the inlet and outlet pairs before proceeding to disconnect the station, the loop continuity not being interrupted at any given moment.

There are different electromechanical devices which carry out this function. A frequent example is the use of a two-position switch, one of said positions being that of normal operation of the equipment and the other one, which could be called a passing position, in which the switch links directly the inlet and outlet pairs.

another way to solve this problem is to sue a connector for both parts, with some mechanical device which links the pairs when beginning disconnecting, before losing the continuity of the contacts, so that the loop is not interrupted at any given moment.

Likewise, Spanish Utility Model No. 276,451 (priority of U.S. Pat. No. 452,170) relates to an electric connector for the specific function of giving continuity in feeding a series of stations when disconnecting any one of them. Said connector, apart from the structural complexity of the assembly, is based upon a plurality of elastic contact pawls which, on the one hand, are in permanent contact with a pair of bars, thereby establishing the connection of the corresponding station when such a connector receives the coupling of the respective connector of the station to be fed, whilst, when this station is disconnected, said contact pawls no longer contact then with the aforementioned pair of bars, said station not being. fed. Now then, at said disconnection moment, the said contact pawls enter into contact with some terminals through which feeding is continued on to the rest of stations, the former staying disconnected.

Said connector requires special configuration pawls, as well as said bars and terminals, in order to achieve either connection, i.e., the direct connection to the station, or the continued feeding to the rest of stations, when said station is disconnected.

The connector according to the invention, far from being of the utmost complexity, is simply constituted, being based on two flat contact sheets associated to a printed circuit, which are driven by mere pushing of both pastilles which are displaced when coupling the mobile or flying connector which carries the corresponding feeding cable.

Precisely the possibility to integrate a printed circuit allows the cheap application of the connector to systems, such as for instance, link panels, which application with conventional connectors was complicated, laborious and, consequently, expensive.

According to the invention, the loop automatic closure device is related to the fixed connector.

The fixed connector has a part thereof protected to a certain extent by a surrounding surface which forms part of a connector support or plate to which it is conveniently fixed.

The electric contact sheets of the fixed connector are connected to a printed circuit which is fixed, in such a way that it can be dismounted, to the insulating block of the fixed connector.

The connector strips to which the shielded inlet and outlet cables of the loop are connected, are fixed to the printed circuit plate.

The device according to the invention comprises flexible sheets which are fixed to the printed circuit by one of their sides, this being a double fixing; by the one hand, it is a mechanical fixing by means of a rivet, and by the other, an electric one, as each one of the sheets is connected to the printed circuit.

The flexible sheets are connected to the printed circuit plate by the rear part or face, taking into account the connection direction of the connectors.

In the insulating block of the fixed contact there appears mounted on two drill holes a male piece, in which drill holes two pivots or fingers of the male piece, which is made of the same insulating material as the connector block, are arranged with capability of sliding.

The fingers of said piece run, in their turn, inside two facing drill holes performed in the printed circuit plate and by their free ends, the fingers are in contact with the flexible sheets.

When the connection between the respective connectors is carried out, the flying connector, i.e., the one which is arranged at the cable end, presses on the end of said piece, thereby elastically displacing the free ends of the sheets, the loop being closed through the working station, since the electric contact between the ends of the sheets and the fixed electric contacts of the printed circuit has been opened.

When the loop is closed through the sheets of the device, this one acts by shortcircuiting the loop before losing the electric contact, whereby the loop never remains open.

For a battery comprehension of the connector according to the invention, a practical example of embodiment is described hereinafter, said embodiment being merely illustrative, never limitative of the invention, all that such as shown in the attached drawing, wherein.

Figure 1:
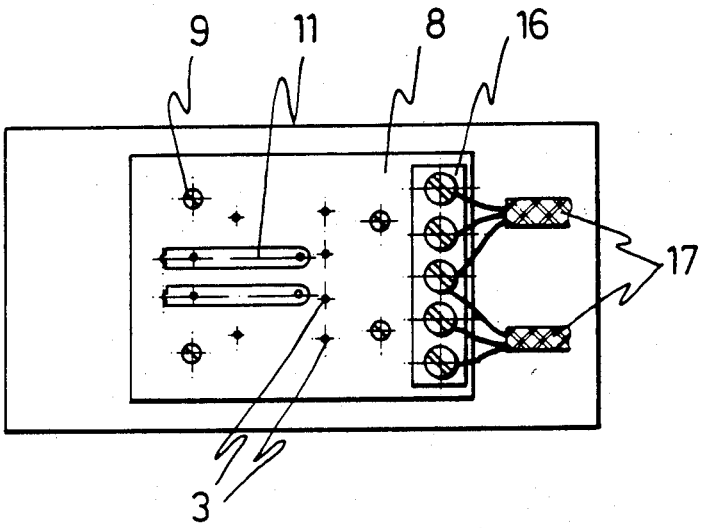
FIG. 1 shows a ground view of the device comprising a fixed connector.
Figure 2:
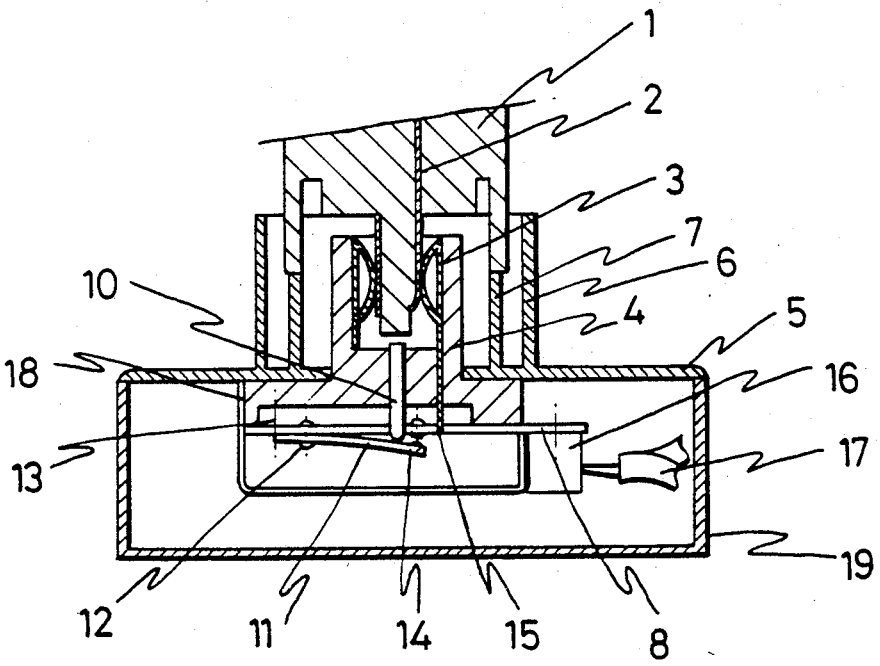
FIG. 2 shows a sectional view according to line A—A of FIG. 1, wherein the flying connector is represented in an intermediate disconnection position, maintaining the electric contact, but the loop being closed through the sheets.
Figure 3:
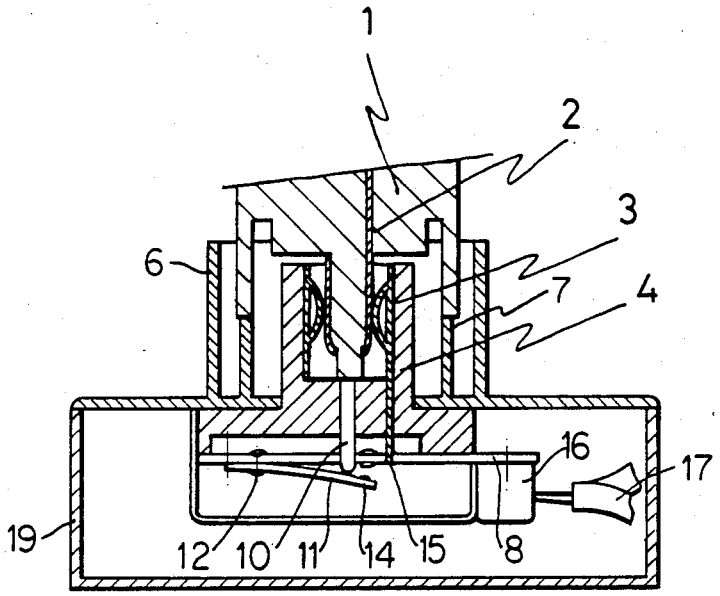
FIG. 3 shows a similar view as that of FIG. 2, the flying connector being connected with closed loop through the work station, as the sheet contacts are opened.

FIGS. 2 and 3 represent the flying connector 1 provided with a contact sheet 2, which, in said figures, is in contact with the sheet 3 of the fixed connector 4.

The fixed connector 4 is related to an outer support 5 which has a protection 6.

A retaining element 7 which prevents from fortuitous electric disconnection cooperates in the coupling of the connectors.

The fixed connector 4 has a printed circuit sheet 8 fixed by means of bolts 9.

An insulating piece 10 is coupled to the fixed connector, which piece slides through drill holes performed in the insulating block of the fixed connector, as well as through facing drill holes performed in the printed circuit plate 8, so that the piece 10 is in contact or presses the flexible sheets 11 which open or close the loop.

The sheets are fixed by one of their ends by rivets 12 to the printed circuit plate 8, whilst they are electrically connected by the printed circuit at points 13.

Each one of the sheets is provided by its free end with a contact 14 facing the printed circuit contact 15.

The printed circuit plate is provided with a connector strip 16 whereto the shielded cables 17 of the loop inlet and outlet are fixed.

The device according to the invention, which constitutes the mechanical and electric operation of the piece 10 with respect to the sheets 11, is closed by a metal shield 18 and all that can be lodged in a case 19.

I claim:

1. A computer connector having an automatic loop closure device for interconnecting a computer network which provides for removal of a workstation without disrupting the integrity of the loop, an electric contact supporting block mounted on a fixed plate and having a printed circuit plate connected to a connector strip to which inlet and outlet cables of the loop are connected, a printed circuit plate connected to the connector strip for accepting a connector therein, said computer connector comprising two flexible metal sheets fixed by one of their ends to the printed circuit, two movable rods, mounted within the support block, the rods displaceable for pressing the free ends of the sheets, such that when a cable end connector is inserted in the mounting block, the rods are displaced separating the two metal sheets and causing the circuit to be opened, and such that when the cable end connector is removed, the sheets recover their initial position due to their elasticity and come into contact to conductively close the circuit which provides loop continuity.

* * * * *